United States Patent [19]

Patterson, III et al.

[11] 4,078,514

[45] Mar. 14, 1978

[54] RIGGING APPARATUS

[76] Inventors: William W. Patterson, III; Eugene F. Grapes, both c/o W. W. Patterson Co., 830 Brocket St., Pittsburgh, Pa. 15233

[21] Appl. No.: 771,264

[22] Filed: Feb. 23, 1977

[51] Int. Cl.[2] ..... B63B 21/04

[52] U.S. Cl. ..... 114/249; 114/218

[58] Field of Search ..... 114/249, 250, 251, 253, 114/77 R, 266, 230, 231, 218; 115/7; 254/149; 248/505, 500, 119 R, 127; 403/167, 347, 209; 59/91, 85; 24/115 K; 85/5 M, 5 R (U.S. only)

[56] References Cited

U.S. PATENT DOCUMENTS

| | | | |
|---|---|---|---|
| 3,507,477 | 4/1970 | Sandy et al. | 114/218 |
| 3,583,045 | 6/1971 | Coyle | 59/85 |
| 3,683,839 | 8/1972 | Harbisch | 114/249 |

*Primary Examiner*—Robert B. Reeves
*Assistant Examiner*—Edward M. Wacyra
*Attorney, Agent, or Firm*—Buell, Blenko & Ziesenheim

[57] ABSTRACT

A permanent rigging pedestal for barges and the like in the form of a base, a pair of spaced apart generally parallel vertical posts fixed at one end to the base, a gusset plate connecting the posts, a vertically extending coaxial pin fixed above each post, each pin adapted to receive the eyebolts of one or more ratchet turnbuckles and a locking bar connecting the pins at their upper ends to prevent removal of the turnbuckle eyebolts. In the preferred embodiment each pin carries a pair of ratchet turnbuckles, one ratchet turnbuckle having a pair of spaced eyebolts forming a U-shaped clevis between which the eyebolt of the other ratchet turnbuckle fits to engage the pin.

8 Claims, 4 Drawing Figures

RIGGING APPARATUS

This invention relates to rigging pedestals and particularly to a permanent rigging pedestal for installation on the deck of barges, towboats and the like where barges or other objects must be quickly and rigidly lashed together.

The need for convenient, rapid safe means for lashing barges and the like together is well known and there are many devices on the market designed to facilitate such lashing. One of the problems in most lashing operations is simply the lack of adequate permanent and universal means for attaching the turnbuckle ratchets and the like used in tightening the lashing. A major problem with most permanently attached lashing devices now available is that they are generally uni-directional and cannot handle pulls through 360°. Moreover, most such devices can handle only a single lashing line.

We have invented a permanent rigging pedestal which will handle four lashing lines through 360° of rotation.

We provide a base member for attachment to a vessel deck, a pair of spaced apart parallel vertical posts on said base member, a gusset plate connecting said vertical posts, a smaller diameter vertical pin extending above and coaxial of each post, each said pin adapted to receive the eyebolts of at least two ratchet turnbuckles and locking means connecting said pins at their ends remote from the posts. Preferably, the two eyebolts of the ratchets on each pin are in the form of a single eyebolt on one ratchet between a pair of eyebolts on a clevis of the other ratchet. Preferably the posts are tubular members with the pins extending into their axis and welded therein.

In the foregoing general description we have set out certain objects, purposes and advantages of our invention. Other objects, purposes and advantages of this invention will be apparent from a consideration of the following description and the accompanying drawings in which.

Figure 4:
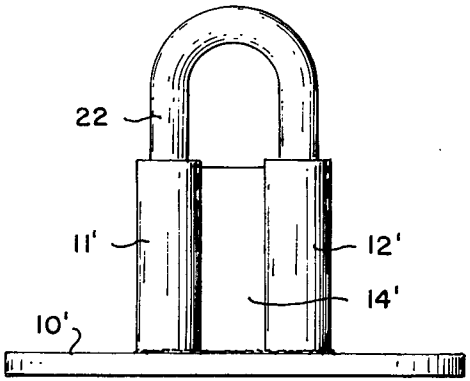
FIG. 4 is a second embodiment of this invention.

Referring to the drawings we have illustrated a generally rectangular base 10 having spaced apart vertical posts 11 and 12 fixed thereon as by welding 13. The vertical posts are parallel and connected by a gusset plate 14. Each post 11 and 12 carries a vertical coaxial pin 15 and 16 which may be inserted in bores 11*a* and 12*a* in the posts and welded or they may be machined from the end of solid posts. Each of the pins 15 and 16 has, adjacent their top end, a safety closure plate or locking means 19 extending between them and having passages 17 and 18 receiving the ends 15 and 16.

Figure 3:
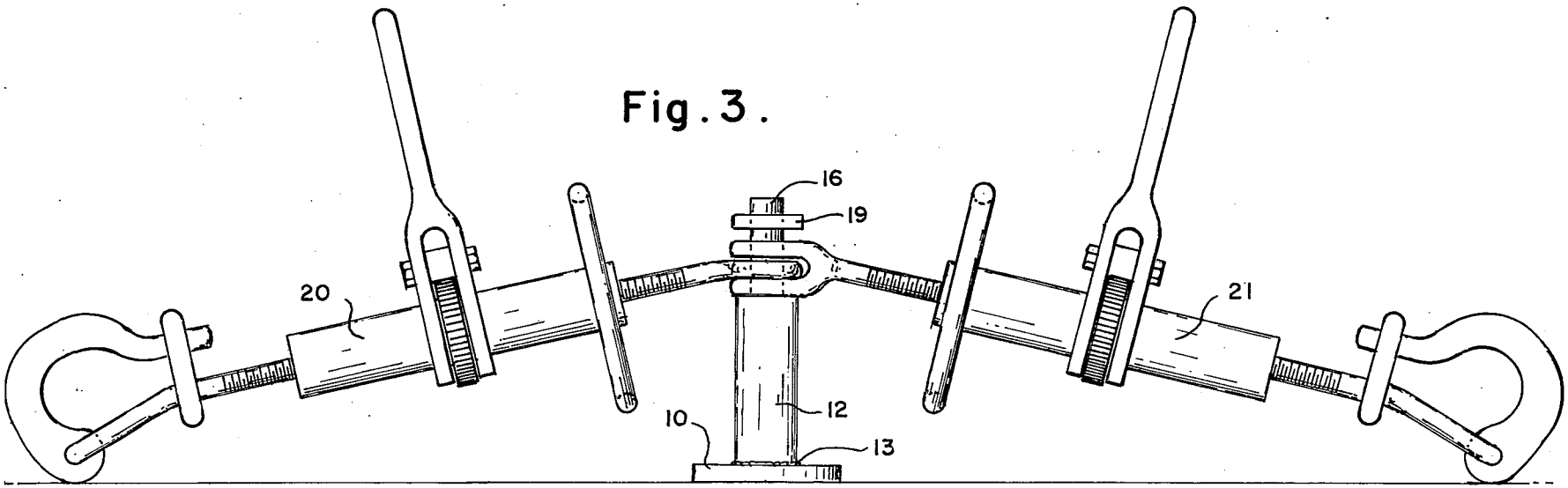
FIG. 3 is an end elevational view of the rigging pedestal of FIG. 1 showing two turnbuckle ratchets attached to one pin thereof.

In use two ratchet turnbuckles 20 and 21, one having a single eyebolt and the other a double eyebolt clevis are attached to each post as shown in FIG. 3. Thus one rigging pedestal can carry four ratchet turnbuckles and the pull on one side of the pedestal aids in balancing the pull on the other.

Figure 2:
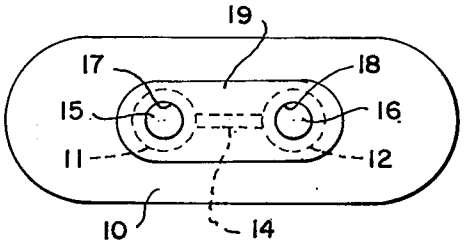
FIG. 2 is a top plan view of the rigging pedestal of FIG. 1.
Figure 1:
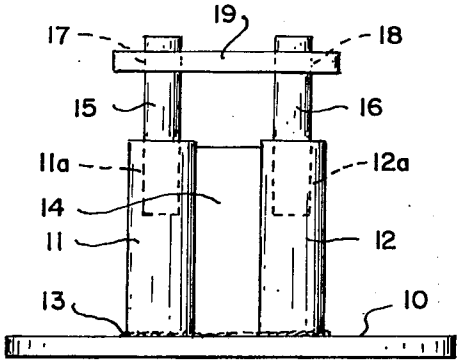
FIG. 1 is a side elevational view of rigging pedestal of this invention.

In FIG. 4, we have illustrated a second embodiment of our invention in which the pins 15 and 16 and closure plate 19 of FIGS. 1—3 are replaced by a single U-shaped pin 22 wherein the legs of the U-shaped pin 22 are the equivalent of pins 15 and 16 of FIG. 1 and the curved portion is the locking means equivalent to closure plate or locking means 19. All other parts are the same and bear like numbers with a prime suffix.

In the foregoing specification, we have set out certain preferred practices and embodiments of our invention, however, it will be understood that this invention may be otherwise embodied within the scope of the following claims.

We claim:

1. A permanent rigging pedestal for barges and the like comprising in combination with at least one ratchet turnbuckle having an eyebolt at one end a base, a pair of spaced apart generally parallel vertical posts fixed at one end on said base, gusset means connecting said posts, a vertical pin extending coaxially of each post above said post and fixed thereto, each said pin receiving the eyebolt of said at least one ratchet turnbuckle and locking means connecting the said pins to each other at their ends remote from the posts to prevent removal of said turnbuckle eyebolts.

2. A permanent rigging pedestal as claimed in claim 1 wherein each of the pins extends coaxially within a portion of the corresponding post and is welded in place therein.

3. A permanent rigging pedestal as claimed in claim 1 wherein the locking means is a rod extending through in line passages at the ends of the pins.

4. A permanent rigging pedestal as claimed in claim 1 wherein the pins are machined on the ends of the posts coaxially therewith.

5. A permanent rigging pedestal as claimed in claim 1 wherein the locking means is a U-shaped member integral with both pins.

6. A permanent rigging pedestal assembly as claimed in claim 1 wherein the ratchet turnbuckles comprise a threaded ratchet tube, a central ratchet drive for rotating said tube, an annular drive wheel surrounding and connected to said tube for rotating the same, separate right and left hand threaded screw members having one end threaded into the tube, one of said screw members having an eyebolt received by said pin, said vertical posts having a height greater than the radius of the annular wheel whereby the wheel is held above said base.

7. A permanent rigging pedestal assembly for lashing barges comprising in combination with at least one pair of ratchet turnbuckles a base, a pair of spaced apart generally parallel vertical posts fixed at one end on said base, gusset means connecting said posts, a vertical pin extending coaxially of each post above said post and fixed thereto, each said pin receiving the eyebolts of said at least one pair of ratchet turnbuckles and locking means connecting the said pins to each other at their ends remote from the posts to prevent removal of said turnbuckle eyebolts, and a pair of ratchet turnbuckles attached to each post, one such ratchet turnbuckle having a pair of eyebolts forming a U-shaped clevis between which the eyebolt of the other ratchet turnbuckle fits on said pins.

8. A permanent rigging pedestal assembly as claimed in claim 7 wherein the locking means is a U-shaped member integral with both pins.

* * * * *